US005643704A

United States Patent [19]

Tamura et al.

[11] Patent Number: 5,643,704

[45] Date of Patent: Jul. 1, 1997

[54] TWO-COMPONENT TYPE DEVELOPER FOR DEVELOPING AN ELECTROSTATIC IMAGE

[75] Inventors: Kishio Tamura; Mayumi Tanaka; Masafumi Uchida, all of Hachioji, Japan

[73] Assignee: Konica Corporation, Tokyo, Japan

[21] Appl. No.: 514,862

[22] Filed: Aug. 14, 1995

[30] Foreign Application Priority Data

Aug. 22, 1994 [JP] Japan ..... 6-196918

[51] Int. Cl.[6] ..... G03G 9/083

[52] U.S. Cl. ..... 430/106.6; 430/108

[58] Field of Search ..... 430/106.6, 108

[56] References Cited

U.S. PATENT DOCUMENTS 5,439,771 8/1995 Baba et al. ..... 430/106.6

*Primary Examiner*—Mark Chapman

*Attorney, Agent, or Firm*—Frishauf, Holtz, Goodman, Langer & Chick, P.C.

[57] ABSTRACT

Disclosed is a two-component developer for developing a electrostatic image comprising a toner particle and a carrier particle comprising a substantially spherical magnetic particle coated with a resin, wherein said substantially spherical magnetic particle contains a compound comprising silicon element in an amount of 100 ppm to 5000 ppm based on said substantially spherical magnetic particle.

18 Claims, 4 Drawing Sheets

TWO-COMPONENT TYPE DEVELOPER FOR DEVELOPING AN ELECTROSTATIC IMAGE

FIELD OF THE INVENTION

The present invention relates to a developer used for developing an electrostatic latent image in an electrophotography method, an electro-static photography method and an electro-static printing method, and more particularly relates to a developer for developing an electrostatic latent image wherein image quality and durability have been greatly improved compared with conventional methods.

BACKGROUND OF THE INVENTION

Generally, there are two kinds of developers for electrostatic latent image development; a one-component type developer and a two-component type developer. Among them, the two-component type developer method is more frequently used due to a point that provision of charge to toner is relatively stable compared to the one-component developer because the so-called carrier which provides charge to toner is mixed with toner and due to a point that, while a color copying machine is spreading remarkably, a magnetic material is not necessary for toner and that the color of the magnetic material does not deteriorate the tone of outputted image.

The two-component type developer is composed of toner and carrier. The carrier is generally classified into electroconductive carrier and insulating carrier. In many cases, however, from the viewpoint of durability and ability to provide an electric charge, resin-coated carriers belonging to the insulating carrier are used. A technology to laminate the surface of this carrier with resin is disclosed in Japanese Patent Publication Open to Public Inspection (hereinafter, referred to as Japanese Patent O.P.I. Publication) Nos. 13954/1972 and 208765/1985.

The two-component developer needs to be stirred in a developing apparatus so that its carrier and toner are mixed and toner is thereby charged for developing.

As an electroconductive carrier, an iron powder carrier and an iron oxide powder carrier are frequently used. In the case of the iron powder carrier, the amount of electric charge provided to the toner tends to be unstable so that there is a problem that fogging occurs on a visible image formed by the developer. The causes for this are that development bias electric current is reduced due to the increase of electric resistance of carrier caused by the adhesion and accumulation of toner particles on the surface of the carrier in the course of stirring and mixing in the developing apparatus and that the amount of electric charge provided to the toner becomes unstable because the surface of the carrier is covered with toner. Accordingly, since a developer composed of the iron powder carrier deteriorates in a small number of using cycles, it is necessary to replace with a new developer earlier.

Therefore, in many cases, resin-coated carrier, wherein the surface of magnetic particles is coated with resin, is used.

This carrier can control the amount of electric charge provided to the toner by selecting resin for coating. In addition, fusion of toner onto the surface of the carrier hardly occurs. Therefore, the advantages are that the amount of electric charge provided to the toner becomes stable and that the developer is excellent in terms of durability compared with the iron powder carrier.

To the contrary, however, different problems which do not occur in the iron powder type carrier occur so that conventional resin-coated carriers cannot produce the desired performance. A major problem of the resin-coated carrier is peeling of the resin-coated layer which occurs when carrier is stressed in the developing apparatus. When the resin-coated layer is peeled off, the ability to provide electric charge to the toner becomes unstable resulting in fogging on visible images formed by the developer. In addition, concurrently with this, the core material of the carrier is exposed so that the electric resistance of the carrier is reduced. The reduction of the electric resistance of the carrier causes thin blurred lines and characters due to excessive development and adhesion of the carrier onto the photoreceptor.

When the surface of the carrier is coated with resin, it is easily influenced by the conditions of resin-coating device and resin-coating circumstances, especially humidity. Accordingly, even with strict control, it is difficult to coat resin on the surface of carrier uniformly and to make the performance of developer stable over a long period. It is the current status that satisfactory performance has not been obtained.

In addition, in order to obtain higher image quality, the particle size of toner is reduced. In the case of the two-component type developer, it may also be necessary to reduce the particle size of carrier in accordance with the particle size of toner in order to provide electric charge sites on the surface of the carrier. However, as reduction of the particle size of carrier is advanced, it becomes more difficult to form a uniform resin-coated layer. Therefore, the mechanical strength of the resin-coated layer becomes unstable so that the above-mentioned shortcoming becomes more obvious. As a result, a problem for practical use problems become greater.

The above-mentioned problem occurs in both the contact development method and the non-contact development method. In the case of the contact development method wherein a magnet brush composed of toner and carrier is brought into contact with a photoreceptor for developing, the above-mentioned problem of resin-coated carrier occurs prominently in a developing apparatus for high speed development. In order to conduct high speed developing, it is necessary to mix and stir supplied toner and carrier at high speed in a developing apparatus. Therefore, carrier receives extremely large stress at a mixing and stirring section. Concurrently with this, in order to conduct high speed developing, it is necessary to rotate developing sleeve at high speed. Therefore, carrier also receives extremely large stress at a development nip section between the development sleeve and the photoreceptor.

In order to reduce the above-mentioned excessive stress, mixing and stirring speed is slightly adjusted, the development nip distance is widened and the rotation speed of developing sleeve is restricted by enhancing toner density. However, these countermeasures cause the occurrence of toner scattering and fogging due to the incapability of providing sufficient electric charge to toner and low image density due to insufficient development material conveyed to the developing region.

In addition, in the case of a non-contact development method wherein development is conducted without contact of the developer layer to the photoreceptor, toner images once developed are not disturbed by contact of the magnetic brush, resulting in enhancement of the image quality. On the other hand, however, developability tends to be inferior compared to the contact developing method. As a countermeasure therefor, it is necessary to narrow the distance between the photoreceptor and the development sleeve. In order to introduce a stable amount of developer to this narrow developing region, it is necessary to set the developer layer uniform and reduce the thickness of it as much as possible. For this purpose, a thin layer forming method by means of a thin layer forming member such as stiff stick magnetic material as proposed in Japanese Patent O.P.I. Publication No. 50184/1990 is effective for forming stable layer thickness. However, though formation of a thin layer by means of a thin layer forming member such as a stick magnetic material has a merit to form a stable layer, stress given to the developer by a member forming the thin layer becomes excessive.

As a countermeasure therefor, as shown in Japanese Patent O.P.I. Publication No. 232362/1974, adding hydrophobic silica fine particles in a resin-coating layer for carrier is proposed. In this case, as the developer is used, the silica fine particles added moves from the original position to the surface of toner so that electrification of toner is hindered. Therefore, this countermeasure cannot be said a sufficient countermeasure.

SUMMARY OF THE INVENTION

Accordingly, an object of the present invention is to provide carrier for developing electric static charge wherein an ability of carrier to provide electric charge and mechanical strength of the resin-coating layer is stabilized at a high level, there is neither fogging nor adhesion of carrier for a long time, density is high and uniform and outputting images having high resolution can be obtained by keeping high adhesion property between the surface of a core material and a resin-coating layer and forming a uniform resin-coating layer.

The above-mentioned object is attained by the following items.

Item 1: A two-component developer for developing an electrostatic image comprising a toner particle and a carrier particle comprising a substantially spherical magnetic particle coated with a resin, wherein said substantially spherical magnetic particle contains a compound comprising silicon element in an amount of 100 ppm to 5000 ppm based on said substantially spherical magnetic particle.

Item 2: The two-component developer of item 1, wherein said two-component developer is employed for contact developing, and said substantially spherical magnetic particle has a saturation magnetization of 50 to 120 emu/g in a magnetic field of 10 KOe.

Item 3: The two-component developer of item 1, wherein said two-component developer is employed for non-contact developing, and said substantially spherical magnetic particle has a saturation magnetization of 20 to 80 emu/g in a magnetic field of 10 KOe.

Item 4: The two-component developer of item 1, wherein a ratio of a minor axis to a major axis of said substantially spherical magnetic particle is 0.7 to 1.0.

Item 5: The two-component developer of item 1, wherein said carrier particle is a substantially spherical magnetic particle containing silicon element of 500 ppm to 3000 ppm.

Item 6: The two-component developer of item 2, wherein said substantially spherical magnetic particle has a saturation magnetization of 60 to 90 emu/g Item 7: The two-component developer of item 3, wherein said substantially spherical magnetic particle has a saturation magnetization of 30 to 60 emu/g Item 8: The two-component developer of item 1, wherein said substantially spherical magnetic particle is a magnetite particle comprising $Fe_3O_4$ having a complete spinel structure.

Item 9: The two-component developer of item 1, wherein a specific volume resistance of said carrier particle is $1\times10^4$ to $1\times10^{10}$ Ωcm.

Item 10: The two-component developer of item 1, wherein a specific volume resistance of said carrier particle is $5\times10^4$ to $1\times10^8$ Ωcm.

Figure 1:
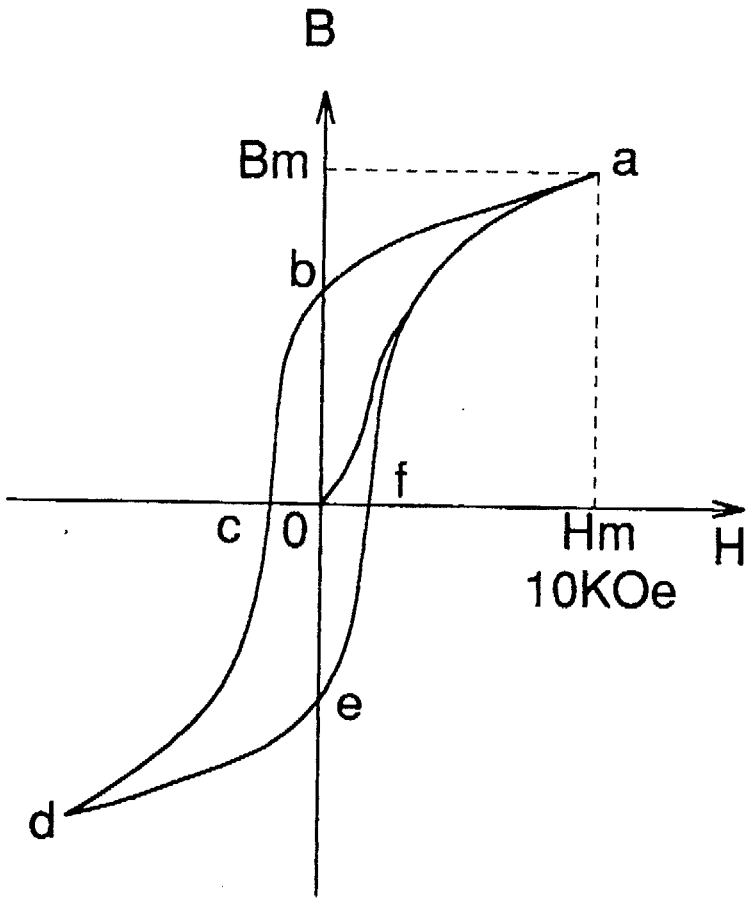
FIG. 1 shows an example of a magnetic hysterisis curve.

1. Photoreceptor
2. Developing sleeve
3. Magnet roll

DETAILED DESCRIPTION OF THE INVENTION

As a result of intensive study, the present inventors discovered that, when a substantially spherical magnetic particle wherein appropriate amount of silicon is contained is used as a core material and aforesaid core material is covered with resin as a carrier, casting properties of a resin-coated carrier can be improved so that the above-mentioned problem can be solved.

In addition to the above, the present inventors also discovered that to use a core material whose magnetizability are within a certain range depending upon the development method of a developing apparatus to which aforesaid carrier is applied is extremely effective for improving the properties required for the above-mentioned resin-coated carrier.

Objects of the present invention are to improve adhesion property between the surface of a core material of carrier and a resin-coating layer to a stronger one and to provide a developer wherein no peeling of the resin-coating layer is resulted in and the above-mentioned problems do not occur even when a copying machine is used for a long time.

For the above-mentioned objects, favorable results can be obtained when substantially spherical magnetic powders are used as a core material of carrier and silicon element is incorporated in aforesaid magnetic particles by 100 to 5000 ppm and preferably by 500 to 3000 ppm.

There are many unknown matters about details of operation mechanism of the effects of the present invention. According to the results of our study, the following can be considered. Due to the existence of silicon element on the surface of a core material and inside of carrier dispersingly, the charging property on the surface of the core material of carrier can be uniform as a whole with different composition in terms of small region. In other words, a surface having different work function can be provided. Due to this, at an interface between the surface of a core material and a resin-coating layer, an appropriate orientation, namely stable orientation is given to a molecular chain constituting the coated resin to be contacted. Therefore, at the interface between the surface of core material of carrier and the resin-coated layer, in addition to physical adhesive force, electric chemical adhesive force can be provided so that extremely strong resin-coated layer can be formed.

As results of study, it was discovered that, among various elements, silicon element can provide the above-mentioned properties. In addition, uniform dispersion to magnetic particles which is necessary in the present invention can be attained relatively easily so that the most favorable results can be obtained.

In addition, the present invention relates to resin-coated carrier using substantially spherical magnetic particles as a core material. Incidentally, "substantially spherical" referred to as here means that the ratio of the minor axis/the major axis of the core material particles is 0.7 to 1.0.

The minor axis/major axis ratio of this core material particle can easily be measured by means of an electron microscope. When the minor axis/major axis ratio of the core material particle is 0.7 or less, stress due to the mixture of the developer in a developing apparatus becomes so great that peeling of a resin-coated layer easily occurs, causing poor images.

Incidentally, the saturation magnetization in a magnetic field of 10 kOe of effective magnetic particles used for the contact development method is 50 to 120 emu/g, more preferably 60 to 90 emu/g.

In the case of the two-component type developer used in the contact development method, it is necessary to convey the developer to developed region by forming a magnetic brush. In such as a case, when carrier whose saturation magnetization exceeds 120 emu/g is used, the magnetic brush becomes dense and hard. When the developer is conveyed in such a state, due to the contact development method, excessive stress is given to the developer in developed region so that sufficient effects of Si element cannot be provided, causing peeling of the resin-coated layer from carrier. On the contrary, when carrier whose saturation magnetization is less than 50 emu/g is used, a magnetic brush having sufficient thickness cannot be formed so that sufficient amount of developer cannot be conveyed to developed region. As a result, outputted image having sufficient density and high resolution cannot be obtained.

In the case of non-contact development method, the saturation magnification of effective magnetic particles located in a magnetic field of 10 kOe is 20 to 80 emu/g, and more preferably 30 to 60 emu/g.

It is necessary for the two-component type developer used in the non-contact development method to form a thin layer of a stable developer for conveying the developer to developed region. In such a case, when carrier whose saturation magnification exceeds 80 emu/g, stress given by the thin layer forming member becomes excessive, causing peeling of the resin-coated layer from the carrier so that poor image is resulted in. To the contrary, when carrier whose saturation magnification is less than 20 emu/g is used, the developing sleeve cannot keep carrier with sufficient magnetic force, resulting in adhesion of carrier.

In the present invention, by the use of magnetic particles wherein silicon element is incorporated in the magnetic particles as a core material for a carrier, a carrier having favorable adhesivity between the surface of the core material and a resin-coated material can be obtained. However, due to incorporating the silicon element, saturation magnetization properties are caused to be reduced. Therefore, when the core material is selected, it is preferable that reduction of the saturation magnetization properties of the core material is foreseen in advance and that the core material having saturation magnetization higher than the saturation magnetization of the carrier is selected.

In both of the contact development method and the non-contact development method, in order to provide suitable electric charge amount to toner, it is necessary to stir and mix the two-component type developer of the present invention in the developing apparatus. In such a case, when carrier whose residual magnetism exceeds 150 Gauss is used, mixing property of toner and carrier is deteriorated due to the coagulation of the developer. In order to supplement lacking mixing property, it becomes necessary to stir the developer by means of excessive stirring force. As a result, stress given to the developer becomes large so that peeling of the resin-coated layer easily occurs, resulting in poor image.

For measuring the saturation magnetization and residual magnetism of the core material of carrier used in the present invention, a direct current magnetizability automatic recording device Model 3257-35 (produced by Yokogawa Denki) may be used. The measurement conditions are as follows.

Carrier to be measured is regulated at 20° C. and 50% RH for 2 hours in advance. Carrier is filled in a cylinder made of acryl having a height of 20 mm and an inner diameter of 15.8 mm. In such an occasion, the weight W (g) of the carrier filled is calculated. Following this, the acrylic cylinder filled with the carrier is set to the direct current magnetizability automatic recording device, with magnetic field of 10 kOe applied, a hysteresis curve wherein y axis represents magnetic flux density B [Gauss] and x axis represents the force of magnetic field H [Oe] is obtained. FIG. 1 shows an example of magnetic hysterysis curve. Saturation magnetization $\sigma s$ is calculated by the use of the following equation from the magnetic flux density Bm when magnetic field of 10 KOe is applied.

magnetic flux density $\sigma s = Bm/(4\pi \cdot W)$ (W: sample weight [g])

In addition the residual magnetism Br can be obtained as a value of magnetic flux density B after 10 kOe is impressed.

The material of magnetic particle usable as a core material of the present invention includes the following ones. Namely, iron powder, ferrite particles such as Zn ferrite, Ni ferrite, Cu ferrite, Mn ferrite, Mn—Zn ferrite, Mn—Mg ferrite Cu—Zn ferrite, Ni—Zn ferrite and Mn—Cu—Zn ferrite and magnetite particles are cited.

However, of the above-mentioned materials, to use magnetite particles is led to more favorable results from the viewpoint that they can have appropriate magnetizability necessary for the present invention relatively easily. In addition, since the specific gravity of carrier composed of magnetite particles is small compared to iron powder carrier, stress given to the carrier can be reduced, resulting in advantageous effects in terms of durability. In addition, carrier composed of magnetite particles has an advantage that specific volume resistance is relatively low even in the case of resin coating. It is so preferable as to effect advantageously in terms of developing properties compared to resin-coated carrier of ferrite particles which have been used frequently. In addition, the magnetite particles are not composed of multiple kinds of metals as in conventional ferrite particles. They have another advantage to simplify a refining process in reprocessing and recycling for re-sourcing used carrier. Incidentally, the magnetite particles referred to here include not only $Fe_3O_4$ having a complete spinel structure but also those containing FeO and $Fe_2O_3$ so that the spinel structure is collapsed partially.

When the specific volume resistance of core material is preferably $1\times10^4$ to $1\times10^{10}$ Ω·cm and more preferably $5\times10^4$ to $5\times10^8$ Ω·cm, favorable performances can be obtained. When this value is $1\times10^4$ Ω·cm or lower, adhesion of carrier onto a photoreceptor occurs, causing serious problem practically. In addition, in the case of $1\times10^{10}$ Ω·cm or higher, sufficient developing properties cannot be obtained, causing poor image density. Incidentally, how to measure the specific volume resistance of core material is as follows. Practically, 1.0 g of core material is filled in an insulating cylindrical container whose cross-sectional area is 1.0 $cm^2$. Under load of 500 g, the height of sample is measured. Following this, in an electric field of DC 100 V, an electric current value is measured. From the resulting height of sample and electric current value, and by the use of the following equation, the specific volume resistance is calculated.

Specific volume resistance value [Ω cm] =

(100 [V] · cross-sectional area [$cm^2$]/(electric current value [A] · height of sample [cm])

A volume-average particles size of core material is preferably 20 to 100 μm and more preferably 30 to 80 μm. The volume-average particles size can be obtained by the use of a laser-diffraction type particle measurer HELOS produced by Nihon Denshi Co., Ltd. When the volume-average particle size of the core material is 20 μm or less, it is difficult to form a resin-coated layer uniformly so that effects by adding silicon element cannot be drawn sufficiently. As a result, problems that the amount of electric charge becomes unstable and that adhesion of carrier occurs are caused. In addition, when the volume-average particle size is larger than 100 μm, the weight of carrier is too large compared to the effects due to addition of silicon element so that peeling of the coated layer caused by collision of carrier each other tends to occur. In addition, magnetic brush lacks minuteness so that outputted image having high resolution cannot be obtained.

For manufacturing the core material used for the resin-coated carrier of the present invention, for example, the following method can be used.

After adding a necessary amount of silicon oxide to the raw material for a core material such as magnetite, the resulting mixture is crushed until the size of particle becomes several μm. Slurry mixed to water was sprayed with a spray drier for granulating. Following this, the granule is subjected to sintering, crushing and classifying for manufacturing. In this occasion, on demand, as an atmosphere of the sintering process, a reducing gas and an inactive gas and, if necessary, an oxidation gas atmosphere can be selected.

The amount of silicon element which can be contained in the core material finally obtained can be measured by an ICP (inductively coupled plasma emission spectrometry) method. Practically, in a 5 liter beaker, deionized water of about 3 liters is poured, and then, the water is heated in a water bath so as to be 45° to 50° C. While washing with about 300 ml of deionized water, about 25 g of magnetic particles mixed to about 400 ml of deionized water is added to a 5 liter beaker together with aforesaid deionized water.

Next, while keeping temperature at about 50° C. and stirring speed at about 200 rpm, mixed acid of extra pure hydrochloric acid or hydrochloric acid and hydrofluoric acid is added thereto, and then, dissolution is started. In this occasion, when hydrochloric acid is used, the density of magnetic particles is about 5 g/liter and an aqueous hydrochloric solution is about 3 normal. From the start of dissolution until the finish of dissolution, sampling of about 20 ml is conducted for several times. The solution is filtrated with a membrane filter for picking up the filtrated solution. From the filtrated solution, silicon element is subjected to quantitative analysis by means of an ICP method.

The number-average molecular weight Mn of resin for covering the surface of core material usable in the present invention is 5,000 to 400,000. The adhesion of those whose number-average molecular weight Mn exceeds 400,000 becomes insufficient so that the coated layer is easily peeled off, and durability becomes undesirable. On the other hand, those whose number-average molecular weight Mn is less than 5000 has poor mechanical strength of the coated layer in itself so that peeling due to internal destroying of the coated layer easily occur, which is not preferable. In addition, those whose number-average molecular weight Mn is less than 5000 has poor fluidity of carrier itself so that toner cannot be provided with charge stably, resulting in fogging on an outputted image. Concurrently with this, carrier surface is easily contaminated by toner, causing a durability problem. In the present invention, the number-average molecular weight of resin for coating use is 5,000 to 400,000, preferably 10,000 to 300,000.

In addition, in the present invention, distribution of the molecular weight of the resin for covering the surface is also important. In the present invention, a resin wherein a value of its weight-average molecular weight Mw divided by its number-average molecular weight Mn, namely Mw/Mn is 1.5 to 15.0 is preferable. A resin whose Mw/Mn is less than 1.5 is extremely sharp in terms of molecular weight distribution. However, contact property with the surface of carrier core material becomes weak so that peeling of a resin-coated layer easily occur. On the other hand, a resin whose Mw/Mn exceeds 15.0 has extremely broad molecular weight distribution. In this case, though the contact property with the surface of carrier core material can be kept sufficiently, the surface of resin-coated carrier is easily contaminated, causing a durability problem.

The number-average molecular weight, the weight-average molecular weight and the distribution of molecular weight of the coated resin of the present invention is measured by a GPC (Gelpermiation chromathography) method wherein THF (tetrahydrofuran) is used as a solvent. Namely, in a heat chamber at 40° C., a column is stabilized. To the column at this temperature, THF is poured at a flow rate of 1 ml/min. as a solvent. The THF sample solution of the coated resin regulated to 0.05 to 0.6 wt % as a sample density is poured by 0.05 to 0.2 ml for measuring. In measuring the molecular weight of the sample, the distribution of the molecular weight of sample was calculated from a relation between a logarithmic value of the calibration curve prepared from several mono-dispersed polystyrene standard sample and a count number. As a polystyrene standard sample for preparing the calibration curve, it is preferable that at least 10 standard polystyrene samples are used. In addition, for a detector, an RI (refractive index) detector is used. In addition, as a column, it is preferable to use a commercially available polystyrene gel column independently or two or more thereof are used in combination in accordance with a measurement range. For example, μ-storage 1500, $10^{-3}$, $10^{-4}$ and $10^{-5}$ (produced by Wasters), shodex KF-80M, KF-802, 803, 804 and 805 (produced by Showa Denko), TSKgel G1000H, G2000H, G2500H, G3000H, G4000H, G5000H, G6000H, G7000H and GMH (produced by Toyo Soda) can be used.

A glass transition point of a resin for coating usable in the present invention is from 60° C. to 150° C. For resins with a glass transition point is less than 60° C., the hardness of the coated layer itself insufficient so that the fluidity of carrier itself becomes poor. As a result, after stirring and mixing, charge cannot be provided to toner stably, causing fogging. In addition, those resins whose glass transition point exceeds 150° C. tend to have poor contact property with the core material. In addition, the resin layer itself tends to be fragile. Due to stress by means of stirring and mixing, peeling of the resin layer easily occur. In the present invention, the glass transition point of the coated resin is 60° to 150° C., and preferably 80° to 130° C. Incidentally, the glass transition point of the coated resin of the present invention can be measured by a differential scanning calorimeter DSC-7 (produced by PERKIN ELMER Inc.) using a differential thermal analysis method.

As a resin for covering carrier usable in the present invention, styrene resins, acrylic resins, styrene/acrylic resins, ester resins, urethane resins, olefin resins such as polyethylene, phenol resins, carbonate resins, ketone resins, fluorine resins such as fluorinated methacrylate and vinylidene fluoride and silicone resins or their denatured products are cited. In addition, resins wherein two or more kinds of the above-mentioned resins are used in combination by means of copolymerization and mixture may be used.

In the present invention, especially effective resins for coating are resins wherein a methacrylic acid ester monomer having an alicyclic structure and a chained methacrylic acid ester monomer not having the alicyclic structure are polymerized. In the above-mentioned manner, by the use of resins having remarkable different structure each other and having a substituent whose degree of freedom of orientation due to rotation of molecular chain is high in combination, adhesive force with the surface of core material can be strengthened. The reason for this is also not certain. However, it can be assumed that, at an interface between the surface of core material and the coated-resin layer and at a space between molecular chains of the coated resin, electric chemical force can be obtained more greatly in addition to physical adhesive force. In addition, when the polymerization mole ratio between the methacrylic acid ester monomer having an alicyclic structure and the chained methacrylic acid ester monomer not having the alicyclic structure is set to be in a range of 20:80 to 80:20, preferable effects can be obtained. The mole ratio of either monomer exceeds 80%, the properties of the other monomer and interaction between the two monomers cannot be obtained sufficiently so that sufficiently strong coated layer cannot be formed.

As a method to form a resin usable in the present invention, conventional methods can be used. Practically, a solution polymerization method, a suspension polymerization method, an emulsification polymerization method, a block-polymerization method and an in-situ polymerization method can be used.

In addition, a preferable coated amount of resin for coating use to the core material is necessary to be changed slightly depending upon the specific gravity of resin. However, the preferable is 0.5 to 10.0 wt % to the core material, and the more preferable is 1.0 to 5.0 wt %. When the amount of resin coating is 0.5 wt % or less, the surface of the core material is easily exposed due to abrasion and peeling when it is used for a long time, resulting in reduced electric resistance of the carrier. The reduction of the electric resistance of the carrier causes blurred thin lines and characters due to excessive development and carrier adhesion. In addition, when the amount of resin coating is 10.0 wt % or more, it is difficult to form a uniform coated layer. In addition, fluidity of carrier is also reduced. As a result, the amount of charge given to the toner becomes unstable, causing fogging.

As a method for covering the core material with resin, conventional methods can be used. Practically, wet coating methods including a method that spray a dispersed solution of the resin obtained by the above-mentioned method onto the surface of magnetic particles and a method that immerses magnetic particles into a dispersed solution and a dry coating method wherein atomized resin for coating is adhered on the surface of magnetic particles electrostatically, and then, the resin layer is adhered and fixed on the surface of magnetic particles by applying heat and/or mechanical stress can be used.

When the present invention is applied to the contact development method, it is effective in a high speed copying machine and a high speed printer wherein a line speed on the surface of a photoreceptor and a development sleeve is large. A machine, which is necessary to output images at high speed, is necessary to charge a replenished toner. In addition, it is necessary to transport sufficient amount of developer to the developed region. Accordingly, it is necessary to enhance mixing and stirring speed inside the developing apparatus and to rotate the developing sleeve at a high speed. Under these conditions, great mechanical stress is inevitably given to a developer. Therefore, peeling of the coated layer on a carrier easily occurs. However, by the use of carrier composed of the present invention, the above-mentioned problems can be solved easily. Practically, the present invention provides noticeable effects when the line speed of the photoreceptor is 300 to 800 mm/s, the developing sleeve line speed is 300 to 2400 mm/s and the line speed ratio of the photoreceptor and the developing sleeve is 1.0 to 3.0.

In addition, when the present invention is applied to the non-contact development method, as a system to form a thin layer of a developer, there are available a magnetic blade system which restricts the layer thickness by the use of magnetic force and a system that presses a bar for restricting the layer thickness of the developer on the surface of development sleeve. In addition, there is also available a method that restricts the layer thickness of the developer by contacting an urethane blade and phosphor bronze plate onto the surface of the developing sleeve.

As a pressing force of a member to restrict the layer thickness of the above-mentioned developer, 1 to 20 gf/mm is preferable and 3 to 15 gf/mm is more preferable. When the pressing force of this member to restrict the layer thickness is smaller than 1 gf/mm, restriction force becomes short so that the transportation of developer becomes unstable, causing poor image. On the other hand, when the pressing force is larger than 20 gf/mm, mechanical stress added to the carrier is too large, causing peeling of the resin-coated layer of the carrier.

It is preferable that the layer thickness of the developer formed on the developing sleeve is 20 to 500 μm in a developed region. In addition, it is necessary that a gap between the developing sleeve and the surface of the photoreceptor is larger than the layer thickness of developer.

In addition, when the present invention is applied to a non-contact development method, excellent effects can be provided when the line speed on the surface of the photoreceptor is 10 to 200 mm/s, the line speed on the surface of the development sleeve is 15 to 500 mm/s and the line speed ratio of the photoreceptor and the development sleeve is 1.5 to 3.5.

When the line speed on the developing sleeve is less than 15 mm/s, it is impossible to transport sufficient amount of developer into the developing region in a unit time so that sufficient image density cannot be obtained. On the contrary, when the shift line speed of the development sleeve exceeds 500 mm/s, noticeable mechanical stress is unnecessarily given to the carrier in a thin layer forming portion, causing peeling of the resin-coated layer of carrier.

As a bias impressing method for developing, in addition to the contact development method and the non-contact development method, a method that provides a DC component only is allowed. In addition, a method that impresses the bias of AC component in addition to the DC component is allowed.

Figure 2:
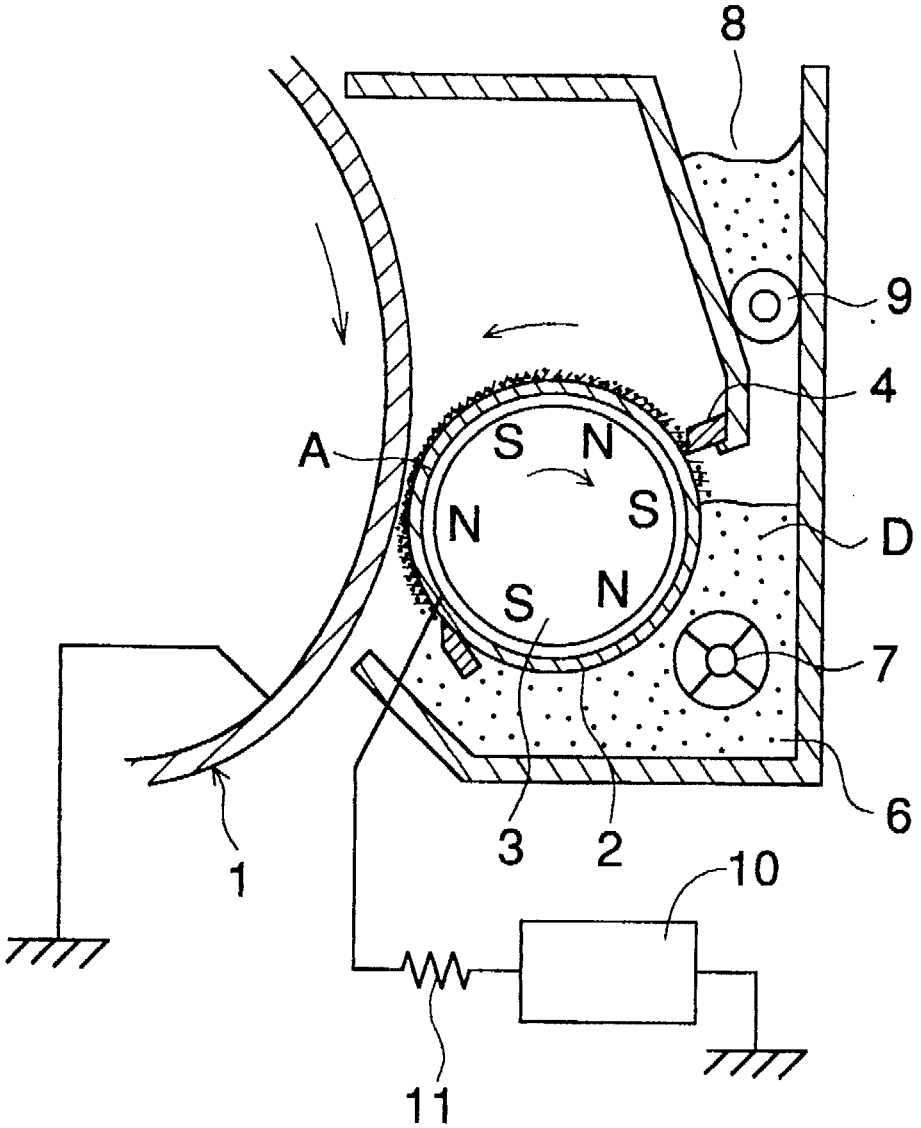
FIG. 2 is a vertical cross-sectional view showing an example of a developing apparatus usable in the present invention.

In both of the contact development method and the non-contact development method, as a developing apparatus applied to the developer of the present invention, those composed of a stirring and mixing section of the developer, a developing sleeve section conveying developer to a developing region and a toner replenishing section can be used. FIG. 2 shows an example of the developing apparatus usable in the present invention (photoreceptor 1, development sleeve 2, magnet roll 3, regulating blade 4, developer pool 6, stirring screw 7, toner hopper 8, supplying roller 9, bias power supply 10, protection resistance 11, developing region A, developer D, and magnetic poles N and S). As constitution of stirring and mixing section of the developer, conventional stirring and mixing systems used for developing apparatuss can be used. As the constitution of the developing sleeve section, those having a constitution that, including a fixed magnet roll, and a nonmagnetic sleeve at an external circumference is rotated by magnetic force of the magnetic roll so that a developer is conveyed to a developing region, can be used. In addition, as an embodiment of the developing sleeve, cylindrical ones whose diameter is 10 to 70 mm are preferable. When the diameter is smaller than 10 mm, sufficient developed region cannot be kept so that developability lacks. Therefore, sufficient image density cannot be obtained. In addition, centrifugal force added to the developer is enlarged, causing splashing of toner, which is not preferable. On the contrary, when the diameter is larger than 70 mm, the developing apparatus becomes unnecessarily large. It is also not preferable.

As a material for a nonmagnetic sleeve of the development sleeve section, aluminum and stainless can be used. In addition, in order to convey the developer to the developing region, those provided with coarsening processing such as flame-coating processing and sand-blast processing are provided on the surface of nonmagnetic sleeve is effective to be used. The magnet roll fixed inside the developing sleeve is composed of plural magnetic poles for the purposes of conveying the developer and of the development. The magnetic pole effecting for development is composed of one or plural apparatuss. In the case of the contact development method, its/their magnetic flux density is 600 to 1400 Gauss and preferably 800 to 1200 Gauss. In the case of the non-contact development method, 300 to 1000 Gauss, and preferably 500 to 900 Gauss. In addition, the appropriate position of the magnetic pole is ±30° to the rotation axis of the developing sleeve with a position wherein the development sleeve and the photoreceptor becomes the closest as a center. When it is set to be ±15, preferable results can be obtained. For the magnetic pole effecting for conveyance, in both cases of the contact development method and the non-contact development method, it is preferable to use those whose magnetic flux density is 400 to 800 Gauss. In addition, when the total magnetic pole for conveyance is at least 3, and preferably 4 to 10, conveyance of the developer becomes extremely stable.

For toner combined with the carrier of the present invention, conventional ones can be used. Practically, those whose main components are a binder resin and a coloring agent wherein a mold lubricant, a charge controlling agent, magnetic substance and a fluidization agent are added if necessary can be used. Practically, a crushing method and a polymerization method can be used. In the crushing method, constituted materials are mixed, and then subjected to fused kneading. Following this, through a chilling step, the resulting substance is subjected to crushing and classifying. Thus, toner is obtained. In the polymerization method, emulsification polymerization and suspension polymerization are used for obtaining toner.

As a volume average particle size of toner, when 1/30 to 1/2 to the volume average particle size of carrier and preferably 1/20 to 1/4 are used, preferable results are obtained. For measuring the volume average particle size of toner, in the same manner as in carrier, a laser diffraction type particle measuring instrument HELOS produced by Nihon Denshi Co., Ltd. can be used for obtaining. When the average particle size of toner by volume against carrier is 1/30 or less, the carrier is too large compared to the toner so that the toner is compressed and deformed by the carrier when stirring developer in the developing apparatus. As a result, the toner is fused onto the surface of the carrier. Accordingly, when used for a long time, an ability to electrify is reduced, causing fogging and resolution reduction. When the ratio of a volume average particle size of toner to carrier is 1/2 or more, the carrier cannot provide enough amount of charge to the toner in spite of stirring of the developer inside the developing apparatus so that the charge amount of toner becomes unstable, causing fogging of the outputted image.

In order to use the toner and the carrier in a form of a two-component type developer, it is necessary to mix the carrier and the toner in advance.

The mixing ratio of the carrier and the toner is necessary to be changed slightly due to the specific gravity and the particle size of the carrier and the toner. In many cases, it is preferable that the toner is employed in an amount of 2 to 15 wt % to the carrier. When the toner mixing ratio is 2.0 wt % or less, the amount of toner conveyed to the developing region becomes insufficient. The outputted image density becomes insufficient. On the other hand, when the toner mixing ratio is 15.0 wt % or more, the amount of toner to the carrier becomes excessive. The toner cannot contact the carrier sufficiently so that the charge amount of toner becomes unstable, causing fogging of the outputted image.

When the magnetic carrier and the toner are mixed, a conventional mixer can be used. In this occasion, the one wherein stress added to the developer is small is preferable. Practically, compared to stirring type mixers such as a Henshell mixer, an auto-rotary type mixers such as a W cone mixer and a rocking mixer can obtain more preferable results.

EXAMPLE

Hereunder, practical examples of the present invention are shown. However, the present invention is not limited thereto.

[I] Example applied to the contact development method

Preparation of carrier

To a raw ferrite material, a necessary amount of fine silicon oxide particles was added. Following this, the mixture was crushed and mixed in water to prepare slurry. The slurry was sprayed with a spray drier for granulating. The granulation was sintered, crushed and classified so that a core material was produced. The particle size was adjusted under the conditions of spraying, granulating and classifying, and incineration was conducted at about 1200° C. under $H_2$ gas atmosphere.

Following this, the core material was subjected to resin coating to prepare carrier used for Example 1 of the present invention. Tables 1 and 2 show lists of the properties of the core material and the coated resin of the carrier used in the Example.

For coating the resin, there was used a method that spray a resin solution onto the core material fluidified due to dried and heated air and dry. Combination of the core material and the coated resin used in Examples of the present invention and comparative invention and the resin coating ratio are shown in Table 3.

Preparation of toner

Toner used for conducting the present invention was prepared by the following manner. However, the present invention is not limited thereto.

To polyester resin, 2 wt % of carnaba wax as a mold lubricant and 12 wt % of carbon black as a colorant were mixed. The resulting mixture was subjected to fused kneading by the use of a biaxial kneading machine.

Following this, through chilling and coarse crushing process, the resulting substance was subjected to fine crushing and wind force classifying so that color particles whose volume average particle size was 7.5 μm was obtained. Following this, as a fluidization agent, 0.5 wt % of hydrophobic silica fine particles were added and mixed to prepare toner used for examples and comparative examples of the present invention.

Preparation of developer

To a V-shaped mixer, 1692 g of carrier and 108 g of toner were charged. The mixture was mixed for 10 minutes to prepare a developer used for the present invention whose toner density was 6.0 wt %.

Evaluation

The above-mentioned developer was charged in a copying machine U-BiX5082 (produced by Konica) using the contact development method. Copying was conducted for 100,000 sheets and the performance of the developer was evaluated under the following requirements. Table 4 shows the results of the evaluation.

Evaluation circumstance: NN circumstance (20° C./50% RH)

Surface potential of the photoreceptor: +850 V

DC bias: +200 V

Distance between the photoreceptor and the developing sleeve (Dsd): 600 μm

Developing sleeve: made of aluminum, the diameter is 55 mm

Line speed of the movement of the development sleeve: 792 mm/s

Line speed of the movement of photoreceptor: 440 mm/s

Position of the development magnetic pole: the upper stream side of the conveyance of the developer +5°

Figure 3:
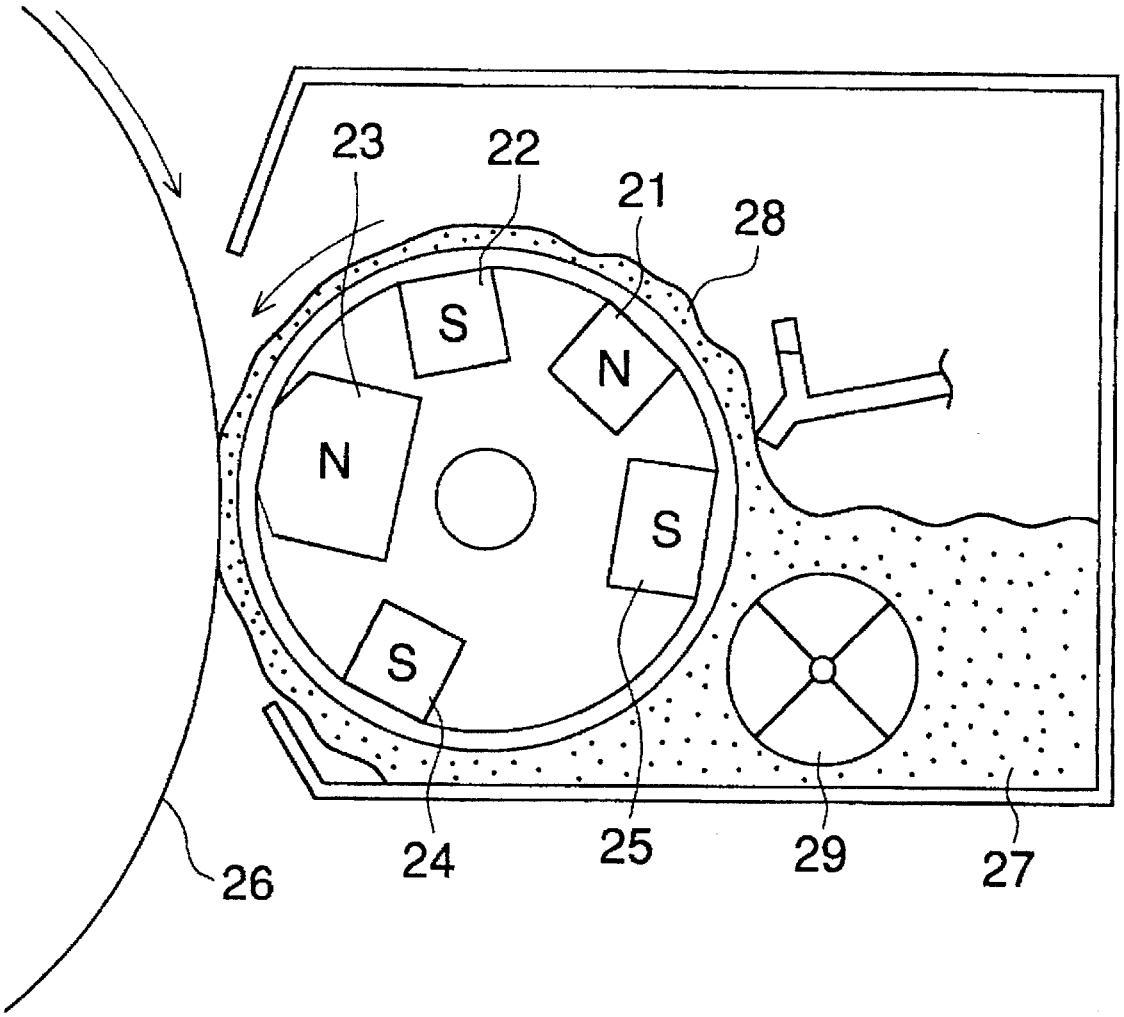
FIG. 3 is a vertical cross section showing schematic structure of a developing apparatus (for the contact development method) used in Examples 1 through 12 and Comparative example 1 through 6.

Schematic structure of the developing apparatus used for the present invention is shown in FIG. 3 (the conveyance magnetic pole (700 Gauss)21, the conveyance magnetic pole (750 Gauss)22, the conveyance magnetic pole (1000 Gauss) 23, the conveyance magnetic pole (750 Gauss)24, the conveyance magnetic pole (600 Gauss)25 photoreceptor 26, developer 27, development sleeve 28 and stirring screw 29).

(Image density)

A contact image whose original density was 1.30 was copied. The relative reflection density of the outputted image to a white paper was measured. Incidentally, for the measurement of density, a Macbeth densitometer (produced by Macbeth) was used. An image density of 1.30 or more was judged to be preferable. In addition, evaluation was conducted twice; for the first copy and for the 100,000th copy.

(Resolution)

Thin line images were copied, and then, the number of lines reproduced per 1 mm width of the outputted image was evaluated. The larger the number of the reproduced thin line, the higher the resolution is so that it was judged to be a favorable image. Evaluation was conducted at 100,000th image.

(Fogging)

After copying 100,000 sheets, a white paper was copied. The relative reflection density of the outputted image on this white paper was measured. For the measurement of density, the Macbeth densitometer was used. An image density of 0.005 or less was judged to be favorable.

(Adhesion of carrier)

After copying for 100,000 sheets, a white sheet of A-3 size was copied, and then, the outputted image was observed. The number of adhered carrier particles observed on the outputted image was measured visually by the use of a magnifying glass. The outputted image on which the number of the adhered carrier particles was 2 or less per one A-3 sheet was judged to be favorable.

(Peeling of a resin-coated layer)

After copying 100,000 sheets, carrier was subjected to sampling from the developing apparatus. By means of SEM, arbitrary 100 pcs of carrier was subjected to surface observation. By means of number of carrier particles wherein breakage and peeling off were observed on the resin-coated layer of the carrier surface, evaluation was conducted. The number of carrier particles wherein abnormality was observed was 2 or less per 100 pcs was judged to be favorable.

(Amount of charge of developer)

Amount of charge was measured by means of a blow-off powder charge amount measuring instrument TB-200 (produced by Toshiba Chemical Co., Ltd.) under NN circumstance (20° C. and 50% RH). Measurement was conducted twice; at the first sheet and at the 100,000th sheet. It was judged to be favorable the difference of charge amount between both is small.

Example 1

With spherical magnetite particles (the content of silicon element was 1000 ppm, the saturation magnetization was 90 emu/g and the residual magnetism was 110 Gauss) whose volume average particle size is 45 μm as a core material, a developer composed of carrier whose surface is covered with cyclohexylmethacrylate/methylmethacrylate copolymer resin (the copolymerization ratio is 50/50, the glass transition point is 112° C. and the number-average molecular weight is 60,000) was prepared for performance evaluation. As a result, high-quality images keeping high image density and resolution from the initial stage and having no fogging could be obtained consistently.

Example 2

With spherical magnetite particles (the content of silicon element was 200 ppm, the saturation magnetization was 80 emu/g and the residual magnetism was 60 Gauss) whose volume average particle size is 60 μm as a core material, a developer composed of carrier using cyclohexylmethacrylate/methylmethacrylate copolymer resin (the copolymerization ratio is 70/30, the glass transition point is 113° C. and the number-average molecular weight is 100,000) was prepared for performance evaluation. As a result, high-quality images keeping high image density and resolution from the initial stage and having no fogging could be obtained consistently.

Example 3

With spherical magnetite particles (the content of silicon element was 2500 ppm, the saturation magnetization was 70 emu/g and the residual magnetism was 140 Gauss) whose volume average particle size is 35 μm as a core material, a developer composed of carrier using cyclohexylmethacrylate/methylmethacrylate copolymer resin (the copolymerization ratio is 30/70, the glass transition point is 110° C. and the number-average molecular weight is 30,000) was prepared for performance evaluation. As a result, high-quality images keeping high image density and resolution from the initial stage and having no fogging could be obtained consistently.

Example 4

A developer composed of carrier in the same manner as in Example 1 except that methylmethacrylate resin (the glass transition point is 108° C. and the number-average molecular weight is 120,000) was used as a resin for coating was prepared for evaluating performance. As a result, high-quality images keeping high image density and resolution from the initial stage and having no fogging could be obtained consistently.

Example 5

A developer composed of carrier in the same manner as in Example 2 except that methylmethacrylate/styrene copolymer resin (the copolymerization ratio is 75/25, the glass transition point is 109° C. and the number-average molecular weight is 80,000) was used as a resin for coating was prepared for evaluating performance. As a result, high-quality images keeping high image density and resolution from the initial stage and having no fogging could be obtained consistently.

Example 6

A developer composed of carrier in the same manner as in Example 3 except that methylmethacrylate/butylmethacrylate copolymer resin (the copolymerization ratio is 40/60, the glass transition point is 65° C. and the number-average molecular weight is 50,000) was used as a resin for coating was prepared for evaluating performance. As a result, high-quality images keeping high image density and resolution from the initial stage and having no fogging could be obtained consistently.

Example 7

A developer composed of carrier in the same manner as in Example 1 except that spherical magnetite particles (the content of silicon element is 1200 ppm, the saturation magnetization was 95 emu/g and the residual magnetism was 250 Gauss) having a volume average particle size of 65 μm was used as a core material was prepared for evaluating performance. As a result, high-quality images keeping high image density and resolution from the initial stage and having no fogging could be obtained consistently.

Example 8

A developer composed of carrier in the same manner as in Example 2 except that spherical magnetite particles (the content of silicon element is 300 ppm, the saturation magnetization was 125 emu/g and the residual magnetism was 190 Gauss) having a volume average particle size of 45 μm was used as a core material was prepared for evaluating performance. As a result, high-quality images keeping high image density and resolution from the initial stage and having no fogging could be obtained consistently.

Example 9

A developer composed of carrier in the same manner as in Example 3 except that spherical magnetite particles (the content of silicon element is 3500 ppm, the saturation magnetization was 45 emu/g and the residual magnetism was 120 Gauss) having a volume average particle size of 65 μm was used as a core material was prepared for evaluating performance. As a result, high-quality images keeping high image density and resolution from the initial stage and having no fogging could be obtained consistently.

Example 10

A developer composed of a core material used in Example 7 and a resin for coating used in Example 4 was prepared for evaluation. As a result, high-quality images keeping high image density and resolution from the initial stage and having no fogging could be obtained consistently.

Example 11

A developer composed of a core material used in Example 8 and a resin for coating used in Example 5 was prepared for evaluation. As a result, high-quality images keeping high image density and resolution from the initial stage and having no fogging could be obtained consistently.

Example 12

A developer composed of a core material used in Example 9 and a resin for coating used in Example 6 was prepared for evaluation. As a result, high-quality images keeping high image density and resolution from the initial stage and having no fogging could be obtained consistently.

Comparative Example 1

A developer composed of carrier in the same manner as in Example 1 except that spherical magnetite particles (the content of silicon element is 50 ppm, the saturation magnetization was 85 emu/g and the residual magnetism was 105 Gauss) having a volume average particle size of 50 μm was used as a core material was prepared for evaluating performance. As a result, fogging occurred on an outputted image and carrier adhesion was observed.

Comparative Example 2

A developer composed of carrier in the same manner as in Example 2 except that spherical magnetite particles (the content of silicon element is 8000 ppm, the saturation magnetization was 65 emu/g and the residual magnetism was 125 Gauss) having a volume average particle size of 45 μm was used as a core material was prepared for evaluating performance. As a result, fogging occurred on an outputted image and carrier adhesion was observed.

Comparative Example 3

A developer composed of carrier used in Example 4 except that a core material used in Comparative example 1 was used was prepared for evaluating performance. As a result, fogging occurred on an outputted image and carrier adhesion was observed.

Comparative Example 4

A developer composed of carrier used in Example 5 except that a core material used in Comparative example 2 was used was prepared for evaluating performance. As a result, fogging occurred on an outputted image and carrier adhesion was observed.

Comparative Example 5

A developer composed of carrier in the same manner as in Example 3 except that spherical magnetite particles (the content of silicon element is 7500 ppm, the saturation magnetization was 35 emu/g and the residual magnetism was 120 Gauss) having a volume average particle size of 65 μm was used as a core material was prepared for evaluating performance. As a result, fogging occurred on an outputted image and carrier adhesion was observed.

Comparative Example 6

A developer composed of carrier used in Example 6 except that a core material used in Comparative example 5 was used was prepared for evaluating performance. As a result, fogging occurred on an outputted image and carrier adhesion was observed.

TABLE 1

List of the properties of core for carrier

| Core No. | Core material | Form (the ratio of the minor axis/the major axis) | Volume average particle size [μm] | Content amount of Si [ppm] | Saturation magnetization [Gauss] | Residual magnetization [emu/g] | Specific volume resistance [Ωcm] |
|---|---|---|---|---|---|---|---|
| 1 | magnetite | 0.95 | 45 | 1000 | 90 | 110 | $2.0 \times 10^7$ |
| 2 | magnetite | 0.96 | 60 | 200 | 80 | 60 | $3.6 \times 10^6$ |
| 3 | magnetite | 0.95 | 35 | 2500 | 70 | 140 | $1.2 \times 10^5$ |
| 4 | magnetite | 0.92 | 65 | 1200 | 95 | 250 | $2.2 \times 10^6$ |
| 5 | magnetite | 0.96 | 45 | 300 | 125 | 190 | $1.8 \times 10^6$ |
| 6 | magnetite | 0.92 | 65 | 3500 | 45 | 120 | $3.5 \times 10^7$ |
| 7 | magnetite | 0.96 | 50 | 50 | 85 | 105 | $1.5 \times 10^5$ |
| 8 | magnetite | 0.92 | 45 | 8000 | 65 | 125 | $4.2 \times 10^8$ |
| 9 | magnetite | 0.95 | 65 | 7500 | 35 | 120 | $2.6 \times 10^7$ |

TABLE 2

List of the properties of resin for coating

| Resin No. | Composition (copolymer) | (Composition ratio) [mole %] | Glass transition point [°C.] | Average molecular weight Mn [10,000] | Average molecular weight Mw [10,000] |
|---|---|---|---|---|---|
| 1 | cyclohexylmethacrylate/ methylmethacrylate | (50/50) | 112 | 6 | 18 |
| 2 | cyclohexylmethacrylate/ methylmethacrylate | (70/30) | 113 | 10 | 36 |
| 3 | cyclohexylmethacrylate/ methymethlacrylate | (30/70) | 110 | 3 | 17 |
| 4 | methylmethacrylate | (100) | 108 | 12 | 40 |
| 5 | methylmethacrylate/ styrene | (75/25) | 109 | 8 | 28 |
| 6 | methylmethacrylate/ butylmethacrylate | (40/60) | 65 | 5 | 22 |

TABLE 3

List of resin-coated carrier

| | Carrier No. | Core No. | Resin for coating | Resin-coating ratio [wt %] |
|---|---|---|---|---|
| Example 1 | 1 | 1 | 1 | 2.4 |
| Example 2 | 2 | 2 | 2 | 1.8 |
| Example 3 | 3 | 3 | 3 | 2.6 |
| Example 4 | 4 | 1 | 4 | 2.4 |
| Example 5 | 5 | 2 | 5 | 1.8 |
| Example 6 | 6 | 3 | 6 | 2.6 |
| Example 7 | 7 | 4 | 1 | 1.7 |
| Example 8 | 8 | 5 | 2 | 2.4 |
| Example 9 | 9 | 6 | 3 | 1.7 |
| Example 10 | 10 | 4 | 4 | 1.7 |

TABLE 3-continued

List of resin-coated carrier

| | Carrier No. | Core No. | Resin for coating | Resin-coating ratio [wt %] |
|---|---|---|---|---|
| Example 11 | 11 | 5 | 5 | 2.4 |
| Example 12 | 12 | 6 | 6 | 1.7 |
| Comparative 1 | 13 | 7 | 1 | 2.2 |
| Comparative 2 | 14 | 8 | 3 | 2.4 |
| Comparative 3 | 15 | 7 | 4 | 2.2 |
| Comparative 4 | 16 | 8 | 6 | 2.4 |
| Comparative 5 | 17 | 9 | 3 | 1.7 |
| Comparative 6 | 18 | 9 | 6 | 1.7 |

TABLE 4

List of the results of Examples and Comparative examples

| No. | Image density Initial | Image density 100000th | Resolution [line/mm] | Fogging density | Number of carrier adhesion | Number of peeled carrier on a coated layer | Charge amount [μc/g] Initial | Charge amount [μc/g] 100000th |
|---|---|---|---|---|---|---|---|---|
| Example 1 | 1.36 | 1.35 | 8.0 | 0.001 | 0 | 0 | 26.2 | 25.8 |
| Example 2 | 1.35 | 1.34 | 8.0 | 0.001 | 0 | 0 | 25.4 | 25.0 |
| Example 3 | 1.35 | 1.37 | 8.0 | 0.001 | 0 | 0 | 26.1 | 26.3 |
| Example 4 | 1.36 | 1.34 | 8.0 | 0.003 | 2 | 2 | 25.2 | 24.1 |
| Example 5 | 1.35 | 1.34 | 8.0 | 0.002 | 2 | 2 | 24.8 | 24.0 |
| Example 6 | 1.36 | 1.33 | 8.0 | 0.003 | 1 | 1 | 24.1 | 23.4 |
| Example 7 | 1.37 | 1.32 | 6.0 | 0.005 | 6 | 6 | 26.4 | 26.5 |
| Example 8 | 1.36 | 1.30 | 6.0 | 0.004 | 8 | 8 | 25.7 | 25.1 |
| Example 9 | 1.35 | 1.31 | 6.0 | 0.005 | 1 | 1 | 25.9 | 25.0 |
| Example 10 | 1.35 | 1.33 | 6.0 | 0.006 | 7 | 7 | 24.8 | 22.9 |
| Example 11 | 1.36 | 1.31 | 6.0 | 0.008 | 8 | 8 | 24.8 | 23.6 |
| Example 12 | 1.35 | 1.32 | 6.0 | 0.008 | 2 | 2 | 24.4 | 23.2 |
| Comparative 1 | 1.33 | 1.28 | 5.0 | 0.016 | 10 | 10 | 25.7 | 19.2 |
| Comparative 2 | 1.35 | 1.24 | 5.0 | 0.025 | 11 | 11 | 25.0 | 17.6 |
| Comparative 3 | 1.32 | 1.25 | 6.0 | 0.018 | 14 | 14 | 24.8 | 16.8 |
| Comparative 4 | 1.30 | 1.23 | 5.0 | 0.024 | 15 | 15 | 24.7 | 17.4 |
| Comparative 5 | 1.35 | 1.22 | 5.0 | 0.027 | 21 | 21 | 25.6 | 16.3 |
| Comparative 6 | 1.32 | 1.21 | 5.0 | 0.028 | 25 | 25 | 23.8 | 15.9 |

[II] Example of application to the non-contact development method

Preparation of carrier

By the use of the same means as in an example of application to the contact development method, a core material was prepared.

Following this, resin-coating was conducted to prepare carrier used in working of the present invention. Table 5 shows a list of carrier used in the working. In addition, for the resin-coating, the same resin as one used in the example of the contact development method was used.

Incidentally, for coating of resin, a method that sprays a resin solution onto a magnetic core material fluidized by means of dried and heated air and dry was used. Table 6 shows combination between the core materials used for the example of the present invention and resins.

Preparation of toner

The toner used in conducting the present invention was prepared by the following method. However, the present invention is not limited to this toner preparation method.

To polyester resin, 2 wt % of carnaba wax as a mold lubricant and 4.0 wt % of phthalocyanine pigment as a colorant were mixed. The resulting mixture was subjected to fused kneading by the use of a biaxial kneading machine.

Following this, through chilling and coarse crushing process, the resulting substance was subjected to fine crushing and wind force classifying so that color particles whose volume average particle size was 7.5 μm was obtained. Following this, as a fluidization agent, 0.5 wt % of hydrophobic silica fine particles were added and mixed to prepare cyan toner used for examples of the present invention.

Preparation of developer

To a V-shaped mixer, 460 g of carrier and 40 g of cyan toner were charged. The mixture was mixed for 10 minutes to prepare a developer used for the present invention whose toner density was 8.0 wt %.

Evaluation

Figure 4:
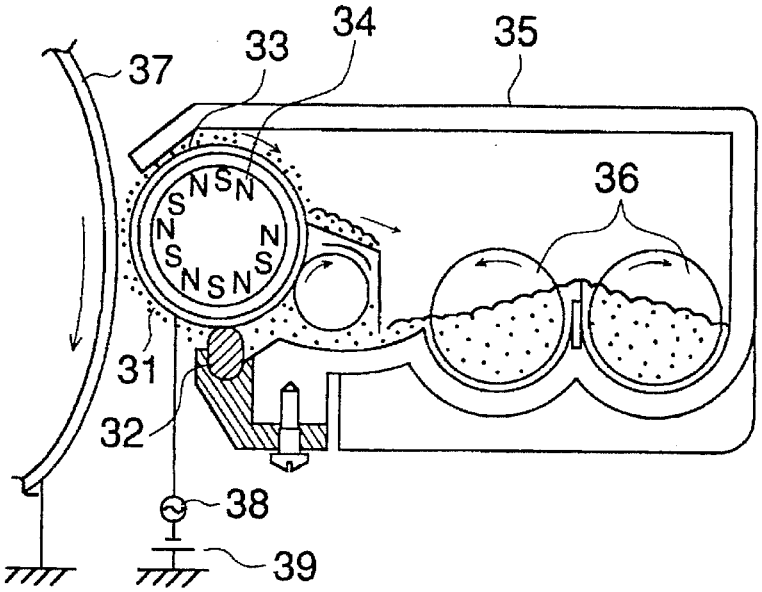
FIG. 4 is a vertical cross section showing schematic structure of a developing apparatus (for the contact development method) used in Examples 13 through 24 and Comparative example 7 through 12.

The above-mentioned developer was charged in a copying machine U-BiX5082 (produced by Konica) using the non-contact development method. Copying was conducted for 30,000 sheets and the performance of the developer was evaluated under the following requirements. Table 7 shows the results of the evaluation. With regard to a developing apparatus, a developing apparatus used in Konica 9028 was modified and used. Developing conditions were as shown below. FIG. 4 shows the structure of the developing apparatus (developer 31, layer pressure restriction member 32, development sleeve 33, magnet roll (700 Gauss) 34, housing 50, stirring fan 36, photoreceptor 37, alternating bias 38 and a DC bias 39).

Evaluation circumstance: NN circumstance (20° C./50% RH)

Surface potential of the photoreceptor: −550 V

DC bias: −250 V

AC bias: $V_{p\text{-}p}$: −50 to −450 V

Distance between the photoreceptor and the development sleeve (Dsd): 300 μm

Line pressure for restricting layer thickness: 10 gf/mm

Member restricting layer thickness: stick made of SUS416 (made of magnetic stainless), the diameter is 3 mm Layer thickness of a developer: 200 μm Developing sleeve: made of aluminum, the diameter is 20 mm Line speed of the movement of the development sleeve: 336 mm/s Line speed of the movement of photoreceptor: 140 mm/s (Image density)

A contact image whose paper density was 1.30 was copied. The relative reflection density of the outputted image against a white paper was measured. For the measurement of density, a Macbeth densitometer (produced by Macbeth) provided with an umber filter thereon was used. An image density of 1.40 or more was judged to be preferable. In addition, evaluation was conducted twice; for the first copy and for the 30,000th copy.

(Dot reproducibility)

Figure 5:
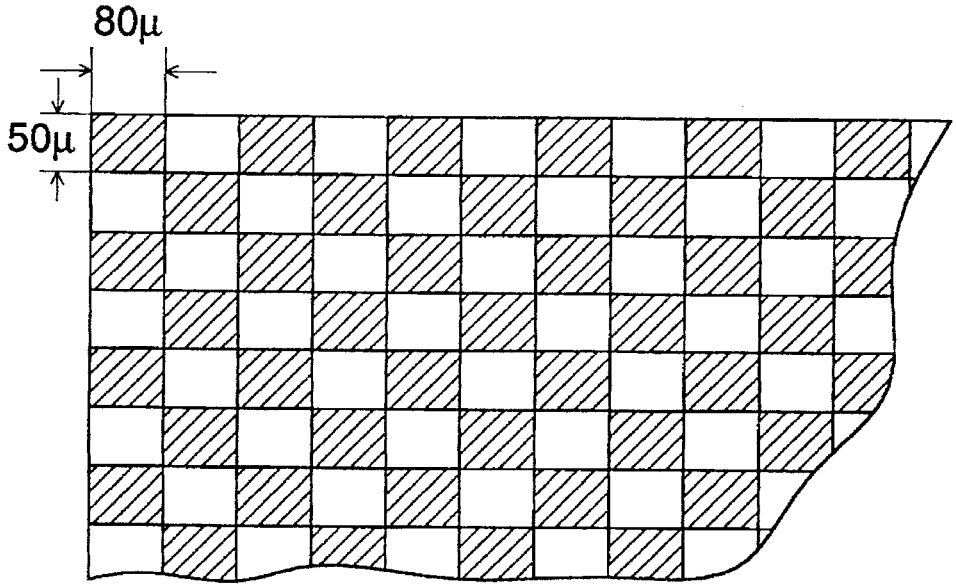
FIG. 5 shows a design of grid used for the evaluation of dot reproducibility.

A pattern of grid with 80×50 μm (see FIG. 5) was copied. By means of an optical microscope, sharpness of outputted image, namely, whether or not there is toner dust onto a non-image portion and missing portion on a black color portion. Incidentally, evaluation was conducted twice; for the first copy and for the 30,000th copy.

(Fogging)

After copying 30,000 sheets, a white paper was copied. The relative reflection density of the outputted image on this white paper was measured. Incidentally, for the measurement of density, the Macbeth densitometer provided with an amber filter thereon was used. An image density of 0.005 or less was judged to be favorable and 0.010 or less was judged to be nonproblematic.

(Adhesion of carrier)

After copying for 30,000 sheets, a white sheet of A-3 size was copied, and then, the outputted image was observed. The number of adhered carrier particles observed on the outputted image was measured visually by the use of a magnifying glass. The outputted image on which the adhered carrier particles was 2 or less per one A-3 sheet was judged to be favorable, and 5 or less was judged to be nonproblematic.

(Peeling of a resin-coated layer)

After copying 30,000 sheets, carrier was subjected to sampling from the developing apparatus. By means of SEM, arbitrary 100 pcs of carrier were subjected to surface observation. Evaluation was made by means of number of carrier particles wherein breakage and peeling off were observed on the resin-coated layer of the carrier surface. The number of carrier particles wherein abnormality was observed was 2 or less per 100 pcs was judged to be good, and 10 or less was judged to be nonproblematic.

(Amount of charge of developer)

Amount of charge was measured by means of a blow-off powder charge amount measuring instrument TB-200 (produced by Toshiba Chemical Co., Ltd.) under NN circumstance (20° C. and 50% RH). Measurement was conducted twice; for the first sheet and for the 100,000th sheet. It was judged to be good that the difference of charge amount between both is small.

Example 13

A developer composed of a carrier consisting of a core material of spherical magnetite particles (the content of silicon was 800 ppm, the saturation magnetization was 40 emu/g and the residual magnetism was 100 Gauss) whose volume average particle size is 45 μm and is coated with cyclohexylmethacrylate/methylmethacrylate copolymer resin (the copolymerization ratio is 50/50, the glass transition point is 112° C. and the number-average molecular weight is 60,000) was prepared for performance evaluation. As a result, high-quality images keeping high image density and resolution from the initial stage and having no fogging could be obtained consistently.

Example 14

A developer composed of a carrier consisting of a core material of spherical magnetite particles (the content of silicon element was 400 ppm, the saturation magnetization was 35 emu/g and the residual magnetism was 60 Gauss) whose volume average particle size is 50 μm and is coated with cyclohexylmethacrylate/methylmethacrylate copolymer resin (the copolymerization ratio is 70/30, the glass transition point is 113° C. and the number-average molecular weight is 100,000) was prepared for performance evaluation. As a result, high-quality images keeping high image density and resolution from the initial stage and having no fogging could be obtained consistently.

Example 15

A developer composed of a carrier consisting of a core material of spherical magnetite particles (the content of silicon element was 2000 ppm, the saturation magnetization was 50 emu/g and the residual magnetism was 120 Gauss) whose volume average particle size is 45 μm and is coated with cyclohexylmethacrylate/methylmethacrylate copolymer resin (the copolymer ratio is 30/70, the glass transition point is 110° C. and the number-average molecular weight is 30,000) was prepared for performance evaluation. As a result, high-quality images keeping high image density and resolution from the initial stage and having no fogging could be obtained consistently.

Example 16

A developer composed of carrier in the same manner as in Example 13 except that methylmethacrylate resin (the glass transition point is 108° C. and the number-average molecular weight is 120,000) was used as a resin for coating was prepared for evaluating performance. As a result, high-quality images keeping high image density and resolution from the initial stage and having no fogging could be obtained consistently.

Example 17

A developer composed of carrier in the same manner as in Example 14 except that methylmethacrylate/styrene copolymer resin (the copolymerization ratio is 75/25, the glass transition point is 109° C. and the number-average molecular weight is 80,000) was used as a resin for coating was prepared for evaluating performance. As a result, high-quality images keeping high image density and resolution from the initial stage and having no fogging could be obtained consistently.

Example 18

A developer composed of carrier in the same manner as in Example 15 except that methyl methacrylate/styrene copolymer resin (the copolymerization ratio is 40/60, the glass transition point is 65° C. and the number-average molecular weight is 50,000) was used as a resin for coating was prepared for evaluating performance. As a result, high-quality images keeping high image density and resolution from the initial stage and having no fogging could be obtained consistently.

Example 19

A developer composed of carrier in the same manner as in Example 13 except that spherical magnetite particles (the content of silicon is 1500 ppm, the saturation magnetization was 40 emu/g and the residual magnetism was 200 Gauss) having a volume an average particle size of 60 μm was used as a core material was prepared for evaluating performance. As a result, high-quality images keeping high image density and resolution from the initial stage and having no fogging could be obtained consistently.

Example 20

A developer composed of carrier in the same manner as in Example 14 except that spherical magnetite particles (the content of silicon is 500 ppm, the saturation magnetization was 90 emu/g and the residual magnetism was 180 Gauss) having a volume average particle size of 45 μm was used as a core material was prepared for evaluating performance. As a result, high-quality images keeping high image density and resolution from the initial stage and having no fogging could be obtained consistently.

Example 21

A developer composed of carrier in the same manner as in Example 15 except that spherical magnetite particles (the content of silicon element is 3600 ppm, the saturation magnetization was 15 emu/g and the residual magnetism was 150 Gauss) having a volume average particle size of 60 μm was used as a core material was prepared for evaluating performance. As a result, high-quality images keeping high image density and resolution from the initial stage and having no fogging could be obtained consistently.

Example 22

A developer composed of a core material used in Example 19 and a resin for coating used in Example 16 was prepared for evaluation. As a result, high-quality images keeping high image density and resolution from the initial stage and having no fogging could be obtained consistently.

Example 23

A developer composed of a core material used in Example 20 and a resin for coating used in Example 17 was prepared for evaluation. As a result, high-quality images keeping high image density and resolution from the initial stage and having no fogging could be obtained consistently.

Example 24

A developer composed of a core material used in Example 21 and a resin for coating used in Example 18 was prepared for evaluation. As a result, high-quality images keeping high image density and resolution from the initial stage and having no fogging could be obtained consistently.

Comparative Example 7

A developer composed of carrier in the same manner as in Example 13 except that spherical magnetite particles (the content of silicon element is 50 ppm, the saturation magnetization was 40 emu/g and the residual magnetism was 110 Gauss) having a volume average particle size of 45 μm were used as a core material was prepared for evaluating performance. As a result, fogging occur on the outputted image and carrier adhesion was also observed.

Comparative Example 8

A developer composed of carrier in the same manner as in Example 13 except that spherical magnetite particles (the content of silicon element is 7500 ppm, the saturation magnetization was 55 emu/g and the residual magnetism was 140 Gauss) having a volume average particle size of 40 μm were used as a core material was prepared for evaluating performance. As a result, fogging occur on the outputted image and carrier adhesion was also observed.

Comparative Example 9

A developer composed of the same carrier as one used in Example 16 except that a core material used in Comparative example 7 was used was prepared for evaluating performance. As a result, fogging occur on the outputted image and carrier adhesion was also observed.

Comparative Example 10

A developer composed of the same carrier as one used in Example 17 except that a core material used in Comparative example 8 was used was prepared for evaluating performance. As a result, fogging occur on the outputted image and carrier adhesion was also observed.

Comparative Example 11

A developer composed of carrier in the same manner as in Example 15 except that spherical magnetite particles (the content of silicon element is 7000 ppm, the saturation magnetization was 25 emu/g and the residual magnetism was 120 Gauss) having a volume average particle size of 60 μm was used as a core material was prepared for evaluating performance. As a result, fogging occur on the outputted image and carrier adhesion was also observed.

Comparative Example 12

A developer composed of the same carrier as one used in Example 18 except that a core material used in Comparative example 11 was used was prepared for evaluating performance. As a result, fogging occur on the outputted image and carrier adhesion was also observed.

TABLE 5

| Core No. | Core material | Form (the ratio of the minor axis/the major axis) | Volume average particle size [μm] | Content amount of Si [ppm] | Saturation magnetization [Gauss] | Residual magnetization [emu/g] | Specific volume resistance [Ωcm] |
|---|---|---|---|---|---|---|---|
| 11 | magnetite | 0.96 | 45 | 800 | 40 | 110 | $1.8 \times 10^7$ |
| 12 | magnetite | 0.94 | 50 | 400 | 35 | 60 | $5.0 \times 10^7$ |
| 13 | magnetite | 0.96 | 45 | 2000 | 50 | 120 | $2.6 \times 10^6$ |
| 14 | magnetite | 0.97 | 60 | 1500 | 40 | 200 | $2.5 \times 10^7$ |
| 15 | magnetite | 0.95 | 45 | 500 | 90 | 180 | $1.6 \times 10^6$ |
| 16 | magnetite | 0.91 | 60 | 3600 | 15 | 150 | $2.4 \times 10^7$ |
| 17 | magnetite | 0.93 | 45 | 50 | 40 | 110 | $2.0 \times 10^6$ |
| 18 | magnetite | 0.95 | 40 | 7500 | 55 | 140 | $1.2 \times 10^8$ |
| 19 | magnetite | 0.96 | 60 | 7000 | 25 | 120 | $4.0 \times 10^7$ |

TABLE 6

| | List of resin-coated carrier | | | |
|---|---|---|---|---|
| | Carrier No. | Core No. | Resin for coating | Resin-coating ratio [wt %] |
| Example 13 | 21 | 11 | 1 | 2.4 |
| Example 14 | 22 | 12 | 2 | 2.2 |
| Example 15 | 23 | 13 | 3 | 2.4 |
| Example 16 | 24 | 11 | 4 | 2.4 |
| Example 17 | 25 | 12 | 5 | 2.2 |
| Example 18 | 26 | 13 | 6 | 2.4 |
| Example 19 | 27 | 14 | 1 | 1.8 |
| Example 20 | 28 | 15 | 2 | 2.4 |

TABLE 6-continued

| | List of resin-coated carrier | | | |
|---|---|---|---|---|
| | Carrier No. | Core No. | Resin for coating | Resin-coating ratio [wt %] |
| Example 21 | 29 | 16 | 3 | 1.8 |
| Example 22 | 30 | 14 | 4 | 1.8 |
| Example 23 | 31 | 15 | 5 | 2.4 |
| Example 24 | 32 | 16 | 6 | 1.8 |
| Comparative 7 | 33 | 17 | 1 | 2.4 |
| Comparative 8 | 34 | 18 | 3 | 2.7 |
| Comparative 9 | 35 | 17 | 4 | 2.4 |
| Comparative 10 | 36 | 18 | 6 | 2.7 |
| Comparative 11 | 37 | 19 | 3 | 1.8 |
| Comparative 12 | 38 | 19 | 6 | 1.8 |

TABLE 7

| | List of the results of Examples and Comparative examples | | | | | | | |
|---|---|---|---|---|---|---|---|---|
| | Image density | | Resolution | Fogging | Number of carrier | Number of peeled carrier on a coated | Charge amount [μc/g] | |
| No. | Initial | 30000th | [line/mm] | density | adhesion | layer | Initial | 30000th |
| Example 13 | 1.45 | 1.43 | 8.0 | 0.001 | 0 | 0 | 25.8 | 25.9 |
| Example 14 | 1.46 | 1.44 | 8.0 | 0.001 | 0 | 0 | 25.5 | 25.1 |
| Example 15 | 1.45 | 1.44 | 8.0 | 0.001 | 0 | 0 | 25.9 | 26.2 |
| Example 16 | 1.43 | 1.41 | 8.0 | 0.004 | 0 | 1 | 25.0 | 24.7 |
| Example 17 | 1.45 | 1.41 | 8.0 | 0.003 | 0 | 2 | 24.3 | 24.2 |
| Example 18 | 1.45 | 1.40 | 8.0 | 0.005 | 1 | 2 | 24.5 | 24.0 |
| Example 19 | 1.42 | 1.41 | 6.0 | 0.008 | 0 | 5 | 25.9 | 25.5 |
| Example 20 | 1.40 | 1.42 | 6.0 | 0.007 | 1 | 9 | 25.2 | 24.9 |
| Example 21 | 1.42 | 1.40 | 6.0 | 0.008 | 3 | 3 | 25.6 | 24.8 |
| Example 22 | 1.41 | 1.40 | 6.0 | 0.010 | 1 | 4 | 24.8 | 23.1 |
| Example 23 | 1.42 | 1.39 | 6.0 | 0.007 | 2 | 8 | 24.0 | 22.9 |
| Example 24 | 1.40 | 1.39 | 6.0 | 0.007 | 5 | 4 | 24.6 | 23.5 |
| Comparative 7 | 1.41 | 1.25 | 5.0 | 0.013 | 10 | 12 | 25.5 | 18.8 |
| Comparative 8 | 1.42 | 1.27 | 5.0 | 0.027 | 21 | 18 | 24.6 | 18.1 |
| Comparative 9 | 1.40 | 1.31 | 6.0 | 0.016 | 8 | 23 | 24.9 | 19.8 |
| Comparative 10 | 1.40 | 1.25 | 5.0 | 0.025 | 23 | 13 | 24.4 | 17.6 |
| Comparative 11 | 1.42 | 1.27 | 5.0 | 0.033 | 41 | 24 | 25.2 | 17.3 |
| Comparative 12 | 1.40 | 1.22 | 5.0 | 0.032 | 38 | 35 | 24.7 | 16.2 |

What is claimed is:

1. A two-component developer, for developing an electrostatic image, comprising (a) a toner particle and (b) a carrier particle comprising a substantially spherical magnetic particle coated with a resin, wherein said substantially spherical magnetic particle contains silicon in an amount of 100 ppm to 5000 ppm based on said substantially spherical magnetic particle.

2. The two-component developer of claim 1, wherein said two-component developer is employed for contact developing, and said substantially spherical magnetic particle has a saturation magnetization of 50 to 120 emu/g in a magnetic field of 10 KOe.

3. The two-component developer of claim 2, wherein said substantially spherical magnetic particle has a saturation magnetization of 60 to 90 emu/g.

4. The two-component developer of claim 2, wherein said substantially spherical magnetic particle is a magnetite particle comprising $Fe_3O_4$ having a complete spinel structure.

5. The two-component developer of claim 4, wherein a specific volume resistance of said carrier particle is $1\times10^4$ to $1\times10^8$ Ωcm.

6. The two-component developer of claim 5, wherein a specific volume resistance of said carrier particle is $5\times10^4$ to $1\times10^8$ Ωcm.

7. The two-component developer of claim 4 wherein said resin has a glass transition point of from 60° C. to 150° C.

8. The two-component developer of claim 1, wherein said two-component developer is employed for non-contact developing, and said substantially spherical magnetic particle has a saturation magnetization of 20 to 80 emu/g in a magnetic field of 10 KOe.

9. The two-component developer of claim 8, wherein said substantially spherical magnetic particle has a saturation magnetization of 30 to 60 emu/g.

10. The two-component developer of claim 8, wherein said substantially spherical magnetic particle is a magnetite particle comprising $Fe_3O_4$ having a complete spinel structure.

11. The two-component developer of claim 10, wherein a specific volume resistance of said carrier particle is $1\times10^4$ to $1\times10^8$ Ωcm.

12. The two-component developer of claim 11, wherein a specific volume resistance of said carrier particle is $5\times10^4$ to $1\times10^8$ Ωcm.

13. The two-component developer of claim 10 wherein said resin has a glass transition point of from 60° C. to 150° C.

14. The two-component developer of claim 1, wherein a ratio of a minor axis to a major axis of said substantially spherical magnetic particle is 0.7 to 1.0.

15. The two-component developer of claim 1, wherein said carrier particle is a substantially spherical magnetic particle containing 500 ppm to 3000 ppm silicon.

16. The two-component developer of claim 1, wherein said substantially spherical magnetic particle is a magnetite particle comprising $Fe_3O_4$ having a complete spinel structure.

17. The two-component developer of claim 1, wherein a specific volume resistance of said carrier particle is $1\times10^4$ to $1\times10^{10}$ Ωcm.

18. The two-component developer of claim 1, wherein a specific volume resistance of said carrier particle is $5\times10^4$ to $1\times10^8$ Ωcm.

* * * * *